United States Patent [19]

Kaieda

[11] Patent Number: 4,912,516

[45] Date of Patent: Mar. 27, 1990

[54] BELT TRANSFERRING DEVICE

[75] Inventor: Shozo Kaieda, Hachioji, Japan

[73] Assignee: Kentek Information Systems, Inc., Allendale, N.J.

[21] Appl. No.: 316,510

[22] Filed: Feb. 28, 1989

[30] Foreign Application Priority Data

Sep. 30, 1988 [JP] Japan ..... 63-244372

[51] Int. Cl.[4] ..... G03G 15/14

[52] U.S. Cl. ..... 355/274; 355/271; 355/275

[58] Field of Search ..... 355/271, 274, 275

[56] References Cited

U.S. PATENT DOCUMENTS

| | | | |
|---|---|---|---|
| 4,341,455 | 7/1982 | Fedder | 355/275 X |
| 4,371,251 | 2/1983 | Morse | 355/274 |
| 4,419,004 | 12/1983 | Kuehnle | 355/274 X |
| 4,571,052 | 2/1986 | Shirai | 355/274 |
| 4,684,238 | 8/1987 | Till et al. | 355/275 |
| 4,714,939 | 12/1987 | Ahern et al. | 355/275 |

FOREIGN PATENT DOCUMENTS 61-117583 0/0000 Japan .

*Primary Examiner*—A. C. Prescott

*Attorney, Agent, or Firm*—Marmorek, Guttman & Rubenstein

[57] ABSTRACT

A belt transferring device for transferring on a record paper a toner image formed onto an image forming member is disclosed. The belt transferring device comprises a transferring belt with a dielectric layer formed on a conductive belt member; a driving device for running the transferring belt; a charging unit for charging the surface of the transfer belt to a polarity opposite to the charging polarity of toner; a brush roller having electroconductive fibers studed onto the outer periphery thereof and for cleaning the surface of the transfer belt; a bias supply source connected to the brush roller for biassing the brush roller to a grounded voltage or to a polarity opposite to the charging polarity of toner; a driving device for rotating and driving the brush roller; and a pair of rollers arranged between the charging and the transferring position and for carrying the transfer belt and a recording paper by clamping them, so that a backup roller positioned at a side facing or opposite to the dielectric layer of the transfer belt is connected to a grounded voltage point or a bias voltage point having the same polarity as the toner charging polarity.

6 Claims, 5 Drawing Sheets

BELT TRANSFERRING DEVICE

BACKGROUND OF THE INVENTION

The present invention relates to a belt transferring device for transferring on a record paper a toner image formed onto an image forming member, such as a photosensitive drum.

In an elecrophotographic printing apparatus or a copying device, an electrostatic latent image is formed onto a photosensitive member or body, the electrostatic latent image is developed to make a toner image, the toner image is transferred onto a recording medium, such as, a record paper and the transferred image is subjected to a fixing step to form a hard copy. Various kinds of transferring devices for transferring the toner image formed onto the photosensitive body are well known, for example, from a belt transferring device disclosed in Japanese Patent Application Laid-open No. 61-117583. In this known belt transferring device, a transfer belt formed by a dielectric material is stretched between two drive rollers, the transfer belt is charged at an even potential by a corona charger, the record paper carried in synchronism is electrostatically attracted onto the transfer belt, and then an image transfer process is performed while carrying the record paper under the state of holding it to the transfer belt. After transferring the toner image onto the record paper, charges on the surface of the transefer belt are removed with A.C. process by a charge removing device which is composed of a high A.C. supply source and a corona charger, after which a cleaning blade is pressed onto the surface of the transfer belt to clean the belt.

Such a transferring device has an advantageous effect that the record paper is electrostatically attracted onto the transfer belt, as well as the transferring and the carrying are performed under the state of holding the record paper onto the transfer belt, thereby obtaining high reliablity for carrying the record paper.

In the above known belt transferring apparatus, however, the surface of the transferring belt is cleaned by depressing a cleaning blade onto the transferring belt so that uneven force is liable to add to the transfer belt and thus the transfer is liable to meander. That is, it is often difficult to depress the cleaning blade onto the running transfer belt with even depressing force, so that the transfer belt becomes meandered even though slightly uneven depression force is effected upon the transfer belt by depressing the cleaning blade. Particularly, in the high speed apparatus the transfer belt is remarkably susceptible of meander by uneven depression force due to high speed running on the transfer belt.

In the belt transferring device, moreover, after transferring and before charging the charges on the transfer belt are removed with A.C. process so as always to cause constant voltage on the transfer belt. In order to remove charges on the transfer belt with A.C. process, corona discharge is performed by using an A.C. high voltage supply source and a corona charger, thereby removing charges on the surface of the transfer belt, so that electric shock and dielectric breakdown or the like are arisen. Moreover, the A.C. high voltage supply source is very expensive, resulting in a high manufacturing cost.

SUMMARY OF THE INVENTION

It is an object of the present invention to eliminate the above described disadvantages of the conventional belt transferring device.

It is another object of the present invention to provide a belt transferring device with high reliability capable of preventing high speed running transfer belt from meandering, and capable of uniformly removing charges on the transfer belt without using high voltage supply source.

According to the present invention, there is provided a belt transferring device comprising a transferring belt with a dielectric layer formed on a conductive belt member; a driving means for running the transferring belt; a charging unit for charging the surface of the transfer belt to a polarity opposite to the charging polarity of toner; a brush roller having electroconductive fibers studed onto outer periphery thereof and for cleaning the surface of the transfer belt; a bias supply source connected to the brush roller for biassing the brush roller to a grounded voltage or polarity opposite to the charging polarity of toner; a driving means for rotating and driving the brush roller; and a pair of rollers arranged between the charging and the transferring position and for carrying the transfer belt and a recording paper by clamping them, whereby backup roller positioned at a side facing or opposite to the dielectric layer of the transfer belt is connected to a grounded voltage point or a bias voltage point having the same polarity as the toner charging polarity.

According to the present invention, a pair of rollers are arranged between the charging position and the transferring position, these rollers pinch and carry the transfer belt and the record paper forcibly, the depressing force caused between the rollers stick fast the record paper to the charged transfer belt forcibly, and thus the thickness of air layer present between the transfer belt and the record paper becomes very small, so that the electrostatic attraction force caused between the transfer or fixing belt and the record paper may be more advantageously effected.

Moreover, the back-up roller is a conductive roller and connected to a grounded voltage point or a bias voltage point having the same polarity as the charging polarity of toner, so that charge injection into the record paper may be performed quickly and thus the record paper may effectively be electrostatically attracted to the transfer belt. Moreover, the charges on the portion of the transfer belt which is not contacted to the record paper, are removed by the backup roller and the charges on the portion of the transfer belt which is contacted to the record paper, are removed by the brush roller, so that the charge removing device is not necessary and thus a cleaning device is obtained which is not affected on the running of the transfer belt by the combination of the backup roller and the brush roller, thereby obtaining the belt transferring device having more high reliabitity. More particularly, the surface region of the transfer belt which is not contacted to the record paper is liable to contaminate so that the brush cleaner may combined with the back-up roller which is biassed by a grounded voltage or a biassing voltage having the same polarity as the charging polarity of toner, and thus the belt transferring device hard to meander may be obtained.

Moreover, the brush roller has a plurality of elastic and conductive fibers studed onto the other periphery thereof, so that substantially uniform depression force may be obtained over whole length in the width direction of the transfer belt even though the brush roller is depressed to the transfer belt, and thus the depression force does not affect on the running of the transfer belt, resulting in a possibility of preventing a generation of meander.

DETAILED EXPLANATION OF THE PREFERRED EMBODIMENTS

Now to the drawings, there is shown one embodiment of a belt transferring device according to the present invention.

Figure 1:
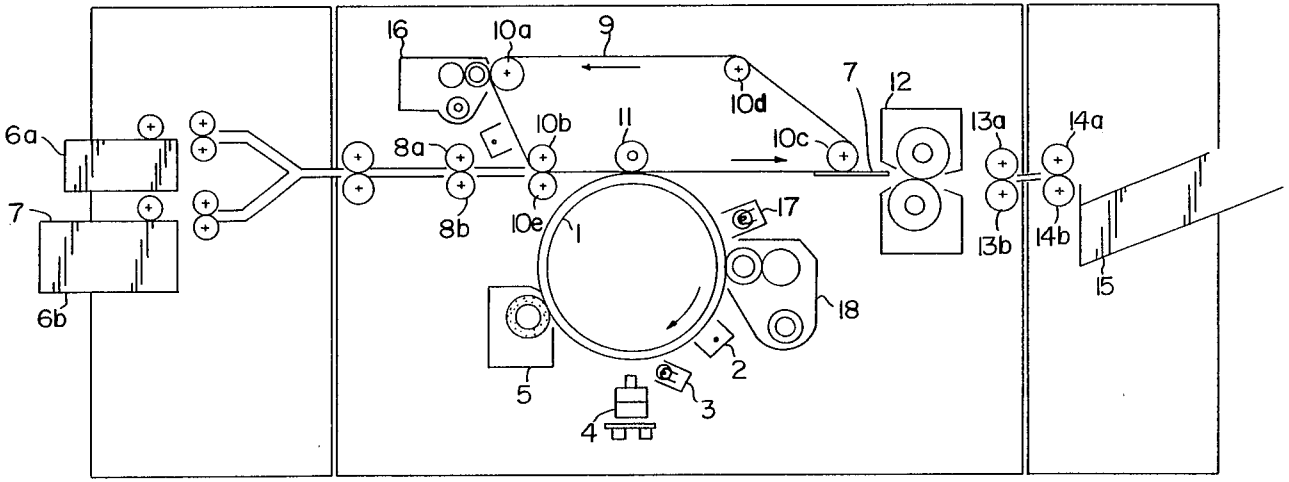
FIG. 1 is a side view showing the construction of one embodiment of a printing apparatus comprising a belt transferring device according to the present invention.

FIG. 1 is a side view showing one embodiment of a high speed printing device comprising a brush cleaning device according to the present invention. In this embodiment, as an image forming member, a photosensitive drum 1 is used which comprises a photosensitive layer formed on an outer perpheral surface of a base drum composed of aluminum (Al). The outer peripheral surface of the photosensitive drum 1 is uniformly charged by a corona charer 2 with positive charges over whole surface thereof, after which auxiliary illuminating light from an auxiliary light source 3 and illuminating light from a printing head 4 are irradiated on the drum 1 to form a latent image. The auxiliary light source 3 irradiates uniformly whole surface of the photosensitive drum 1. The printing head 4 is constructed by an LED array formed by arranging for example a plurality of light emitting elements in a straight line over a width of the image to be recorded. This LED array 4 is irradiated according to the image signal supplied from the image forming device and the irradiated light of very small spot focused by a SELFOC (trade name)lens is illuminated to the photosensitive drum 1. The latent image formed by the illuminated light from the auxiliary light source 3 and the LED array 4, is developed by a developing device 5, to form a toner image. While a record paper 7 is supplied from feeding cassetts 6*a* or 6*b* in synchronized with the photosensitive drum 1. The record paper 7 is taken out one by one from a cut sheet feeder by means of feeding rollers, carried by carrying rollers, and carried to a transferring position after the timings for synchronizing and carrying the photosensitive drum 1 are taken by a pair of registering rollers 8*a* and 8*b*. A transfer belt 9 is arranged so as to face the photosensitive drum 1. The transfer belt 9 is composed of a conductive plastic sheet having an insulating dielectric layer thereon and is stretched between four rollers 10*a*, 10*b*, 10*c* and 10*d* with a capability of running. This transfer belt 9 is run at the same speed as the running speed and in the same direction as the running direction of the photosensitive drum 1 and is charged with a polarity opposite to the charging polarity of toner by means of the corona charger 20. While the record paper 7 carried therein in synchronization with the rotation of the photosensitive drum 1 is contacted to the transfer belt 9 through a pair of rollers 10*b* and 10*e*, electrostatically attracted thereto and carried to a transfer position in accordance with the transfer belt. At this transfer position, a transfer roller 11 composed of an elastic and conductive rubber roller is arranged at rear side of the transfer belt and the transfer belt 9 and the record paper 7 are lightly depressed onto the surface of the electrosensitive drum 1 with the use of elastic force. When the record paper 7 is contacted onto the surface of the photosensitive drum, the electric field formed by charges on the surface of the transfer belt transfers the toner particles present on the surface of the photosensitive drum onto the record paper. After transferring of the toner particls, the record paper 7 is carried while electrostatic attracting it onto the surface of the transfer belt and separated at the position of the roller 10*c* and then entered into a fixing device 12, in which the toner particles are fixed onto the record paper. After the fixing of the toner particls, the record paper 7 is delivered in a delivery stacker 15 under the state of face down through carrier rollers 13*a*, 13*b* and delivery rollers 14*a*, 14*b*. While the transfer belt is reused through a brush cleaning device 16 for cleaning the transfer belt. After transfer process, the charges on the photosensitive drum 1 are removed uniformly by a charge removing device 17 such as a lamp so that the surface potential of the photosensitive drum is decreased to the residual potential. The residual toner particles on the photosensitive drum 1, are removed by means of a brush cleaning device 18, and then the photosensitive drum 1, is again charged by the corona charger 2 over the whole surface thereof so as to form next latent image.

Figure 2:
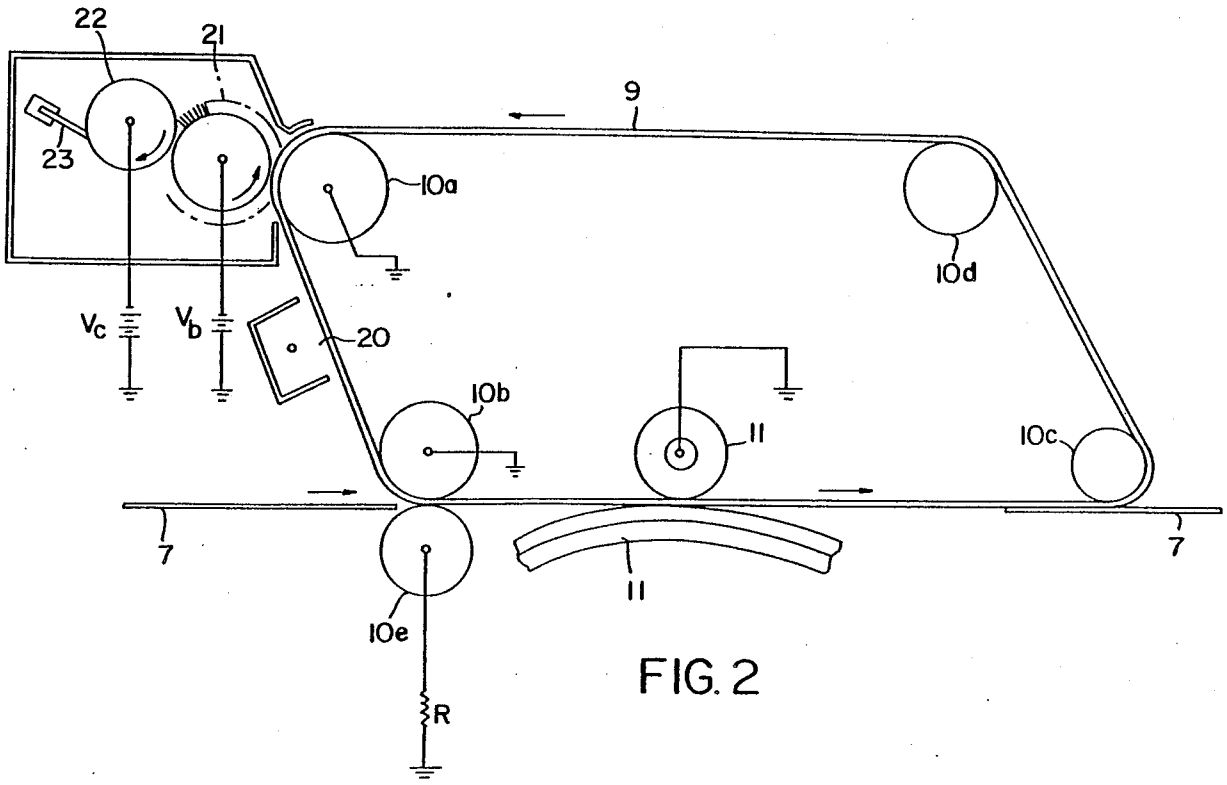
FIG. 2 is a side view showing detailed construction of the belt transferring device according to the present invention.
Figure 3:
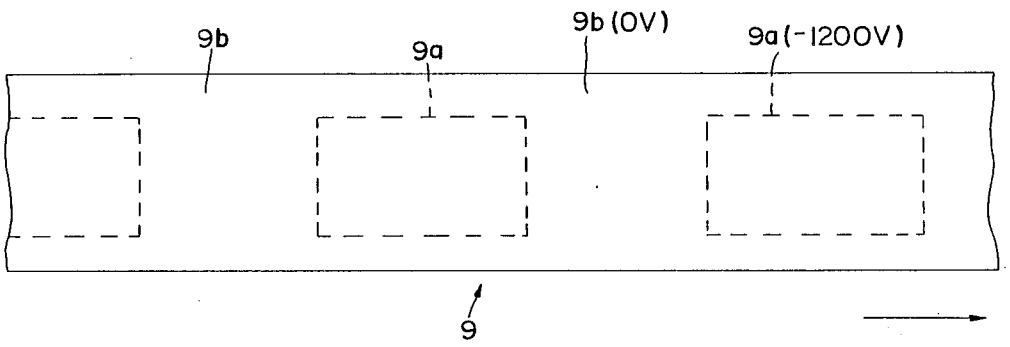
FIG. 3 is a plan view showing a charging distribution of the transfer belt for use in the belt transferring device.
Figure 4C:
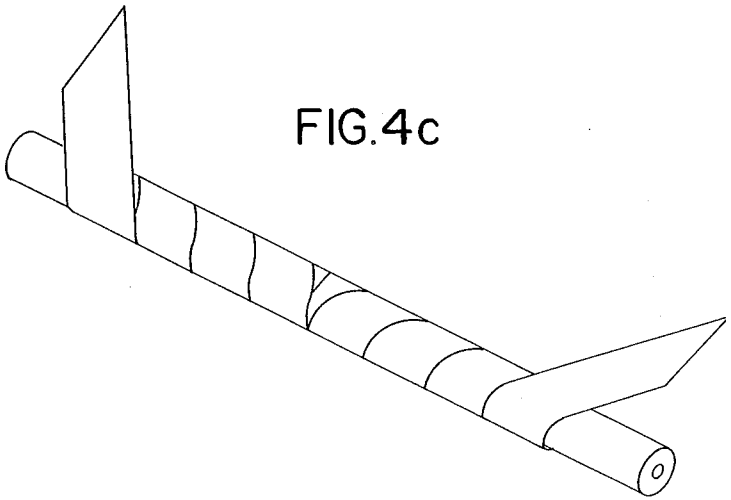
FIGS. 4*a*~4*d* are perspective views and side views each showing brush roller for use in the belt transferring device.
Figure 4D:
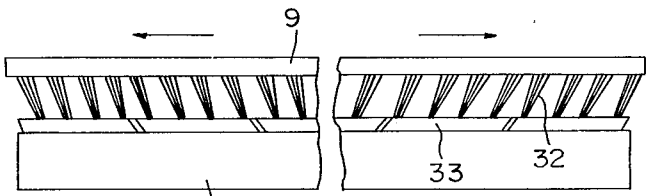
Figure 4A:
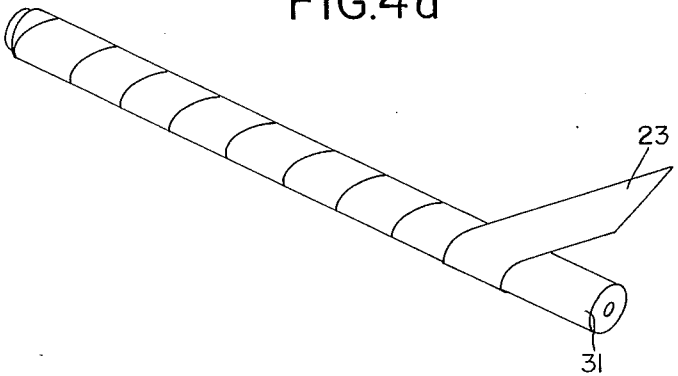
Figure 4B:
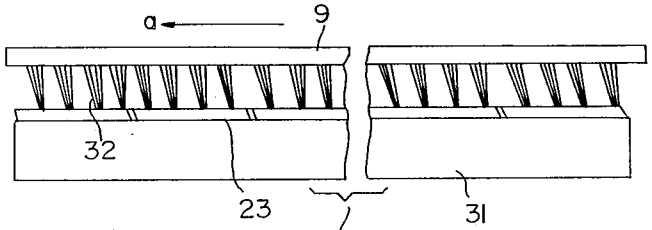

FIG. 2 shows a detailed construction of the belt transferring device according to the present invention. The transfer belt 9 comprises conduction belt member formed by impregnating a conductive material such as carbon with plastic material. The conductive belt member has an outer peripheral surface which is coated by a dielectric layer to form an endless belt. The transfer belt runs in the direction of an arrow. This transfer belt 9 is charged by a charger 20 with a polarity opposite to the charging polarity of toner, in this embodiment, at −1200V. A pair of rollers 10*b*, 10*e* are arranged between this charging position and the transferring position at which the transfer belt 9 is contacted to the photosensitive drum 1, so that the record paper 7 is electrostatically attracted to the transfer belt 9 by these rollers 10*b* and 10*e*. That is, the record paper 7 is entered between the roller 10*b* and the backup roller 10*e*, the depressed force effected between the rollers 10*b* and 10*e* makes the record paper and the transfer belt closely contacted, thereby utilizing the electrostatic attraction advantageously. In this case when the backup roller 10*e* is in the electrically floating state the induction of charges on the record paper becomes insufficient. In the present embodiment, therefore, the back-up roller 10*e* is composed of the conduction elastic rubber roller and is connected to a grounded point through a resistor R. In this way, when the back-up roller 10*e* is composed of the conductive elastic rubber roller and is connected to the grounded point, charges may simultaneously be injected into the record paper from the back-up roller, at the same time the record paper is contacted closely to the transfer belt, so that the record paper may be electrostatically attracted to the transfer belt effectively. While the surface region of the transfer belt 9 which is not contacted to the record paper 7 is directly contacted to the back-up roller 10*e*. When the surface of the transfer belt is directly contacted to the grounded backup roller, the charges on the surface of the transfer belt are leaked through the back-up roller so that the potential of this surface region becomes decreased to substantially grounded potential. It considered that this charge leakage is caused by the discharge or charge injection. It is, however, found by experiment that the voltage of the transfer belt surface is decreased to substantially zero volt. Therefore, it is considered that both phenomena are present in this case. The back-up roller 10*e* serves as a charge injection means for the region of the transfer belt contacted to the record paper, and as a charge removing means for the region of the transfer belt which is not contacted to the record paper. As a result of this, the surface potential of the transfer belt is held about −1200V at the region 9*a* contacted to the record paper, and is decreased to about 0 V at the region 9*b* contacted to the backup roller. The contamination of the transfer belt is mainly dust of the record paper and adhesion of toner caused by contacted to the photosensitive drum drum 1, or the like, and is liable to adhesion to the portion of the transfer belt which is not contacted to the record paper, particularly, is liable to adhesion during the time that the transfer belt is run between rollers 10*b* and 10*c*. As in the present invention, therefore, when charges on a part of the transfer belt surface are removed by the back-up roller 10*e* just before that the charged portion of the transfer belt is opposite to and contacted to the photosensitive drum 1, adhesion of unnecessary toner onto the surface of the transfer belt may effectively prevented.

In the present invention, toner and dust adhered to the surface of the transfer belt, are removed by a brush roller 21. This brush roller 21 comprises conductive elastic fibers which are composed of rayon or regenerated cellulosic fibers and nylon fibers impregnated with conductive materials. These conductive elastic fibers are studed onto the outer periphery surface of the brush roller 21. This brush roller 21 is so arranged to contact with the transfer belt 9 and journally supported by an insulative bearing rotatably, and then connected to a drive motor (not shown), so as to rotate in a direction opposite to the running direction of the transfer belt. Moreover, the brush roller 21 is connected to a bias source $V_b$ of about −300V having a polarity opposite to the charging polarity of toner through a flange. A metal recovery or collection roller 22 is arranged so as to contact it to the brush roller 21 at the position opposite thereto. This recovery roller 22 is rotatably and journally supported through the insulative bearing and connected to a negative bias source $V_c$. This bias source $V_c$ has the same polarity as that of a bias source $V_b$ for the brush roller and is set to the voltage larger than that of the bias voltage $V_b$, that is, about—600V. The recovery or collection roller 22 rotates in the same direction as that of the brush roller 21 and has its pheripheral speed $v_c$ which is set larger than the peripheral speed $v_b$ of the brush roller 21, that is $v_c > V_b$. The collection roller 22 is provided with a scraper 23 made of urethane rubber or thin metal so as to tach it thereto, thereby scraping off the toners or the like adhered onto the outer peripheral surface of the collection roller 22. Toners and dust adhered onto the surface of the transfer belt are mechanically swept away therefrom by the brush roller 21 to clean the surface of the transfer belt. In this case the brush roller 21 is biassed at about −300V, so that the toners or dust thus scraped off are attracted to the brush roller. Toners or dust thus attracted thereto are carried to the position opposite to the collection roller 22 and are attracted electrostatically to the collection roller 22 by the bias voltage applied thereto, so that these toners and dust are scraped off by the scraper 23 and deposited on the bottom surface of a housing 24. If the small amount of toners and dust are adhered onto the transfer belt, or toners floating in the air are only adhered onto the surface of the transfer belt, toners and dust adhered onto the surface of the conductive fibers of the brush roller are separated from the brush roller with centrifugal force caused by rotation thereof, so that the surface of the transfer belt may be make cleaning adequately by only the brush cleaning and thus the collection roller and the scraper are not necessary.

Next, the charge removing effect of the brush roller is explained. Since the conductive fibers have small diameter which are studed onto the outer peripheral surface of the brush roller 21, the firing potential between the transfer belt and the conductive fibers becomes substantially decreased, so that gaseous discharge arises between the brush roller and the transfer belt, thereby decreasing the surface potential of the transfer belt to the bias voltage of the brush roller. Since the fact that the surface potential of the transfer belt is decreased to a voltage equal to the bias voltage of the brush roller is confirmed by an experiment, it is considered that both the gaseous discharge and charge injection arise in this case. The brush roller 21, thus, serves not only as the cleaning means for removing toners and dust adhered onto the transfer belt surface, but also as the charge removing means for decreasing the potential on the transfer belt surface to a constant potential. Therefore, the potential of the region of the transfer belt 9 on which the record paper is held with electrostatic attraction becomes decreased from −1200V to −300V, and the potential of the other region of the transfer belt 9 on which charges thereon are removed becomes increased to −300V. As a result of this, the surface potential of whole transefer belt surface is held uniformly with charge removal effect by the brush roller. After having been held at uniform potential over whole surface by the brush roller, the transfer belt is again charged at uniform surface potential by the corona charger 20 and run to the charge transfer position, so that the transfer belt is always held at constant potential without using the charge removing device and is run to the charge transfer position.

FIG. 4 shows one embodiment of means for preventing meander of the transfer belt caused by the brush roller. FIG. 4*a* is a perspective view showing the conventional brush roller. FIG. 4*b* is a cross sectional view of the conventional brush roller cut at a plane including its longitudinal axis thereof. FIG. 4*c* is a perspective view showing one embodiment of the brush roller according to the present invention. FIG. 4*d* is a cross sectional view showing the brush roller cut at a plane including the longitudinal axis thereof. The brush roller 30 comprises a sleeve 31 consisting of Aluminum and a base cloth 33 wound spirally on the outer periphery thereof. On the base cloth a plurality of conductive fibers 32 are studed. As shown in FIG. 4*a* and 4*b*, the conventional brush roller is provided with a base cloth spirally wound over whole length thereof along one direction, so that as shown in FIG. 4*b* whole conductive fibers 32 are obliquely contacted to the transfer belt in one direction. As a result, the transfer belt is pushed out in one direction by a depressed force caused by an elastic force of the conductive fibers, so that the transfer belt is liable to the meander running. On the contrary, as shown in FIGS. 4*c* and 4*d* according to the present invention the base cloths are wound in opposite directions to each other from the center portion to both ends of the sleeve 31, so that at shown in FIG. 4*d*, the conductive fibers are obliquely contacted to the transfer belt in opposite direction to each other at respective sides about the center of the brush roller, and thus the depressed forces effected on the transfer belt and caused by the elastic force of the conductive fibers are canceled or compensated with each other. In the high speed apparatus, when the transfer belt 9 is subjected to pressures for pulling it in opposite directions along the width direction which are caused by the elastic force of the conductive fibers, the meander of the transfer belt may be effectively prevented.

Figure 5:
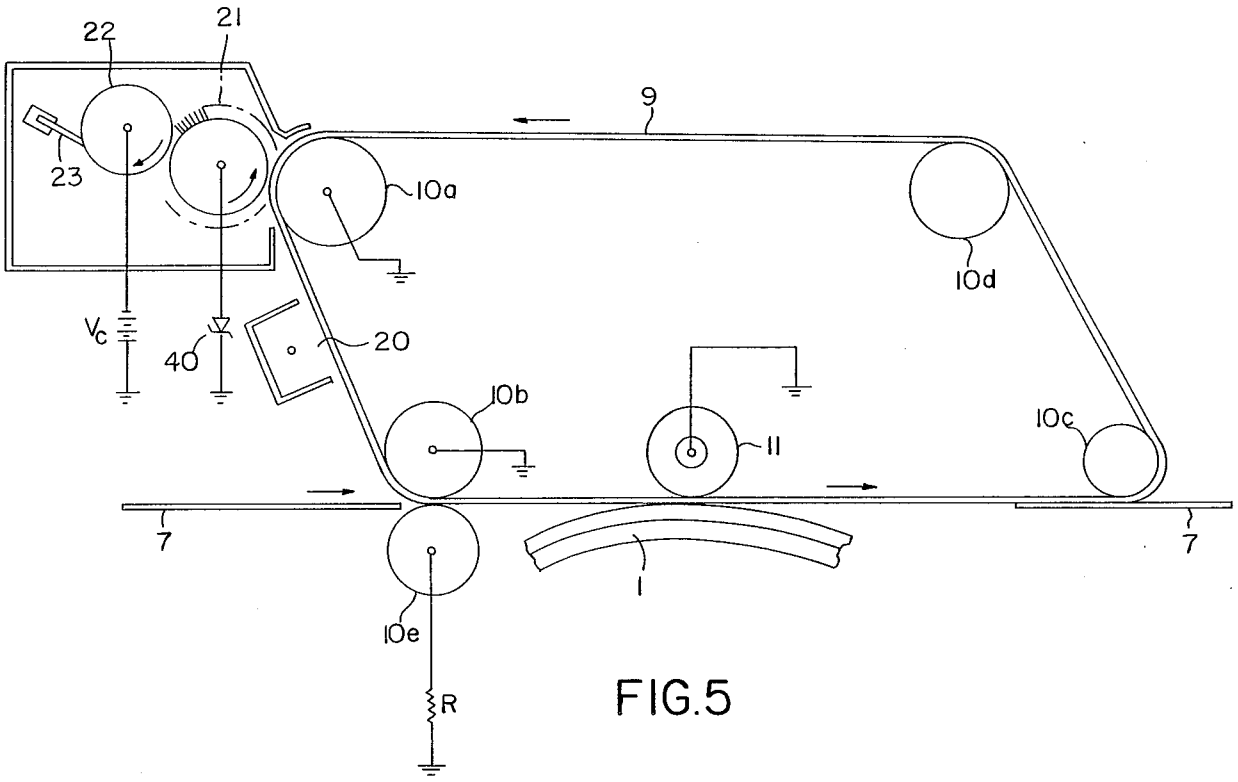
FIG. 5 is a side view showing a detailed construction of a modification of the belt transferring device according to the present invention.

FIG. 5 is a diagram showing the construction of a modification of the belt transferring device according to the present invention. In FIG. 5, similar to those previously described with reference to FIG. 2 are denoted by the same reference numerals. In this embodiment, the bias source for the brush roller is composed of a Zener diode 40 instead of the bias source $V_c$ for the recovery roller. The Zener diode 40 has a breakdown voltage smaller than the voltage of the bias source $V_c$ for the recovery roller. The cathode of the Zener diode 40 is connected to the ground. The breakdown voltage of the Zener diode 40 is, for example, in the order of one half the voltage of the bias source $V_c$ for the recovery roller. When the Zener diode 40 becomes conductive, the diode 40 serves as a bias source, so that the brush roller 21 is always biassed at the breakdown voltage of the Zener diode 40. A Zener diode is cheaper that the DC bias source, so that manufacturing cost may be decreased.

The present invention is not limited to the above embodiment and various changes and alterations may also be possible. For example, the above embodiment was constructed in such a manner that the back-up roller is grounded through a resistor, but the above construction may be changed or altered. For example, the back-up roller may be grounded directly, or a bias voltage having the same polarity as charging polarity of toner may be applied to the back-up roller in order to effect charge injection to the record paper as fast as possible. Particularly, the bias voltage having the same polarity as charging polarity of toner of few hundred volts may be applied to the back-up roller in order to effectively remove the charges on the surface region of the transfer belt which is not contacted to the record paper.

The back-up roller, also, may be composed of a conductive brush roller and thus the synchronously carried record paper may be depressed on the transfer belt by using the elastic force of the conductive fibers. In this case, the charge injection to the record paper and the charge removing of the transfer belt may effectively carried out, since a curvature of the conductive fibers is large and the threshold voltage of the gaseous discharge becomes decreased. If a conductive elastic rubber roller having miniature unevenness in the order from few μm to few hundreds μm is utilized, the charge injection effect and the charge removing effect may be performed more effectively.

Moreover, if a charger of scorotoron type is utilized as a charger, the charge potential of the transfer belt may be always held at constant potential even though there is a slight difference between the charge removing efficiency of the brush roller and the charge removing efficiency of the back-up roller. In addition to the corona charger, a brush charging device consisting of a brush having conductive fibers studed thereon and a bias source for biassing the above brush at given potential, and a roller charging device may also be utilized as a charger.

The above embodiment utilizes a construction that a bias voltage having a polarity opposite to charging polarity of toner is applied to the brush roller, but this biassing is not always necessary. That is, when the brush roller is arranged in such a manner that the running direction thereof is the same direction as that of the transfer belt and the peripheral speed in higher than the running speed of the transfer belt, toner particles or the like adhered to the transfer belt surface may be swept away downward by a mechanical cleaning force due to the rotation of the brush roller, as that the surface of the transfer belt may be adequately cleaned in an image forming apparatus having small amount of dust and toner particles adhered to the transfer belt. In this case, therefore, the transfer belt surface may be cleand by the grounded brush roller, and the toner particles and dust adhered to the conductive fibers of the brush roller may also be removed by the mechanical cleaning due to the collection roller and/or electrical attraction due to the bias source $V_c$.

in the above embodiment, also, the running direction of the periphery of the brush roller is set to a direction opposite to the running direction of the transfer belt, but this running direction may be set to the same direction as that of the transfer belt. Moreover, the brush roller may be rotated in the same direction as the running direction of the transfer direction, and the collection roller may be rotated in direction opposite to the running direction of the brush roller. In this case, the cleaning performance to the brush roller may be performed more effectively due to the collection roller, since the conductive fibers of the brush roller are mechanically beaten by the collection roller.

What is claimed is:

1. A belt transferring device comprising a transfer belt with a dielectric layer formed on a conductive belt member; a driving means for running the transfer belt; a charging unit for charging the surface of the transfer belt to a polarity opposite to the charging polarity of toner; a brush roller having electroconductive fibers studed onto outer periphery thereof and for cleaning the surface of the transfer belt; a bias supply source connected to the brush roller for biassing the brush roller to a grounded voltage or polarity opposite to the charging polarity of toner; a driving means for rotating and driving the brush roller; and a pair of rollers arranged between the charging and the transferring position and for carrying the transfer belt and a recording paper by clamping them, whereby a back-up roller positioned at a side facing or opposite to the dielectric layer of the transfer belt is connected to a grounded voltage point or a bias voltage point having the same polarity as the toner charging polarity.

2. A belt transferring device as claimed in claim 1, wherein the brush roller is rotated in the same direction as a running direction of the transfer belt at peripheral speed faster than a running speed of the transfer belt, a recovery or collection roller is arranged to face it to the brush roller, and the recovery roller is rotated in the direction opposite to the rotating direction of the brush roller.

3. A belt transferring device as claimed in claim 1, wherein the brush roller is connected to a grounded voltage point, and the recovery roller is composed of a conductive material and is connected to a bias source having a bias voltage having a polarity opposite to charge polarity of the toner.

4. A belt transferring device as claimed in claim 1, wherein the brush roller is connected to a bias voltage point having a polarity opposite to a charge polarity of the toner, and the voltage of the bias voltage point connected to the conductive recovery roller is made higher than the voltage of the bias supply source for the brush roller.

5. A belt transferring device as claimed in claim 4, wherein the bias voltage source connected to the brush roller is composed of a Zener diode having a breakdown voltage of absolute value smaller than that of the bias source of the recovery roller.

6. A belt transferring device as claimed in claim 3, wherein the conductive brush roller comprises a conductive roller member and foundation cloths having conductive fibers studed thereto at one side thereof, and the foundation or base cloths are wound either around the center portion of the longitudinal direction of the brush roller on either sides thereof in opposite directions to each other.

* * * * *